US005272273A

United States Patent [19]

Watanuki et al.

[11] Patent Number: 5,272,273

[45] Date of Patent: Dec. 21, 1993

[54] ELECTRONIC MUSICAL INSTRUMENT WITH FUNCTION OF REPRODUCTION OF AUDIO FREQUENCY SIGNAL

[75] Inventors: Kazuhito Watanuki, Fussa; Kazuko Kuwabara, Kokubunji, both of Japan

[73] Assignee: Casio Computer Co., Ltd., Tokyo, Japan

[21] Appl. No.: 627,042

[22] Filed: Dec. 13, 1990

[30] Foreign Application Priority Data

Dec. 25, 1989 [JP] Japan ..... 1-336050

[51] Int. Cl.[5] ..... G10H 5/00; G10H 1/26; A63H 5/00

[52] U.S. Cl. ..... 84/649; 84/609; 84/652

[58] Field of Search ..... 84/649, 650, 653, DIG. 29, 84/635, 636, 642, 644, 657, 652, , 666, 667, 668, 670, 713, 669, 609, DIG. 12, 637

[56] References Cited

U.S. PATENT DOCUMENTS

| | | | |
|---|---|---|---|
| 3,562,397 | 2/1971 | Uchiyama et al. | 84/642 |
| 4,357,854 | 11/1982 | Hirano | 84/713 |
| 4,566,362 | 1/1986 | Kikumoto | 84/642 |
| 4,615,024 | 9/1986 | Usui | 84/DIG. 29 |
| 4,624,171 | 11/1986 | Yuzawa et al. | 84/DIG. 29 |
| 4,757,736 | 7/1988 | Tajima et al. . | |
| 4,829,869 | 5/1989 | Katada et al. | 84/609 |
| 4,924,745 | 5/1990 | Kimpara et al. | 84/649 |
| 4,926,738 | 5/1990 | Kondo et al. | 84/DIG. 12 |
| 4,960,030 | 10/1990 | Fujimori | 84/649 |
| 5,069,104 | 12/1991 | Shibukawa | 84/609 |
| 5,101,707 | 4/1992 | Kondo | 84/637 |
| 5,138,925 | 8/1992 | Koguchi et al. | 84/609 |
| 5,189,237 | 2/1993 | Koguchi | 84/609 |

*Primary Examiner*—Bernard Roskoski
*Assistant Examiner*—Jeffrey W. Donels
*Attorney, Agent, or Firm*—Frishauf, Holtz, Goodman & Woodward

[57] ABSTRACT

In an electronic musical instrument having an audio reproducing function, when a plurality of keys are operated while a reproducing operation is in a halt state, the reproducing operation starts again in response to the operation of the keys. A movable operator is assigned with a particular function. The audio reproducing operation is controlled in accordance with the function assigned to the movable operator.

2 Claims, 10 Drawing Sheets

ELECTRONIC MUSICAL INSTRUMENT WITH FUNCTION OF REPRODUCTION OF AUDIO FREQUENCY SIGNAL

BACKGROUND OF THE INVENTION

1. Field of the Invention

The present invention relates to an electronic musical instrument equipped with a reproducing apparatus of audio frequency signals.

2. Description of the Related Art

A number of disk records for a music education such as disk records of schools and manuals have been on the market. People used to practice an acoustic instrument such as a piano, listening to the disk record. A disk record of a symphony on which a part of a particular musical instrument such as a piano is not recorded is on the market, too. People can enjoy playing the piano, listening to such a disk record, as if they are playing the piano with a symphony orchestra.

But a disk record player and a musical instrument are separate and independent goods so that people sometimes encounter following inconveniences while they practice a musical instrument or enjoy playing a musical instrument with background music of an orchestra.

Sometimes, the disk record player and the musical instrument are installed apart from each other because there is not enough space in a room for them. In this case, a musician has to come to the disk record player to make it start reproduction of a disk record or to exchange the disk record with others while he is playing the musical instrument. It is very troublesome for him to move frequently between the musical instrument and the disk record player to manipulate the disk record player. Even in case that the disk record player and the musical instrument are installed comparatively close to each other, it will be uneasy for the musician who sits at the piano to manipulate the disk record player. Particularly, it will be burdensome to a beginner musician who has to repeatedly practice a same part of a music to come to the disk record player to manipulate it several times.

The above troublesome problem will be all the same to a musician who plays an electronic musical instrument, using an audio reproducing equipment, since an electric appliance with both functions of musical instrument and audio reproducing equipment has not yet been available on the market though both the electronic musical instrument and the audio reproducing equipment are an electric appliance.

SUMMARY OF THE INVENTION

The present invention has been made to remove the above mentioned problems and inconveniences, and it has an object to provide an electronic musical instrument which can be used to play with a reproduced background music.

Another object of the invention is to provide an electronic musical instrument which is capable of reproducing an audio frequency signal in response to a start of a playing operation of musical instrument, when a musician starts playing the musical instrument while a reproducing operation of audio frequency signals halts.

Still another object of the invention is to provide an electronic musical instrument which is capable of controlling an audio reproducing equipment in accordance with a particular function assigned to at least one movable operator.

An instrument according to the invention is constructed as follows to achieve the above objects.

One embodiment of the invention comprises audio reproducing means; halt-instruction means for instructing said audio reproducing means to halt a reproducing operation of an audio frequency signal; playing operation means; musical tone generating means for generating a pertinent musical tone in response to operation of said playing operation means; and audio-reproduction re-start instruction means for instructing said audio reproducing means to re-start a reproducing operation of an audio frequency signal in response to operation of said playing operation means when said playing operation means is operated while said audio reproducing means halts its reproducing operation in accordance with the instruction by said halt-instruction means.

The above audio reproducing means is an audio equipment which reproduces music recorded on recording media such as a Compact Disk (CD), a magnetic tape and a disk record.

The halt-instruction means is a foot-switch or a microphone.

The playing operation means is, for example, keys of a keyboard instrument, a pad and a drum stick of percussion instruments or strings of a stringed instrument.

The musical tone generating means consists of a digital sound source such as PCM sound source, PD sound source and FM sound source and it generates pertinent musical tones of these sound sources.

The audio-reproduction re-start instruction means comprises a micro-processor and a read only memory (ROM) that stores a program for controlling operation of the micro-processor.

In the embodiment of the above construction, when the halt-instruction means gives an instruction to the audio reproducing means to halt its reproducing operation while the audio reproducing means is performing the reproducing operation, the audio reproducing means halts its reproducing operation. When the playing operation means is operated while the audio reproducing means halts its reproducing operation, the audio-reproduction re-start instruction means controls the audio reproducing means in response to the operation of the playing operation means so as to start the reproducing operation again.

When a player successively operates the playing operation means while the audio reproducing means is in the reproducing operation again, pertinent musical tones are generated in response to operations of the playing operation means. Hence, the player is allowed to play the musical instrument accompanying at a reproduced music or to practice the musical instrument by operation of the playing operation means.

The player is also allowed to halt the reproducing operation of the audio reproducing means at any time by causing the halt-instruction means to give an instruction to the audio reproducing means, which is in the reproducing operation and he is also allowed to release the audio reproducing means from the halt state where the reproducing operation stops by operation of the playing operation means. In this manner, while the player is playing the electronic keyboard instrument (in case that the playing operation means is a keyboard), he can operate the halt-instruction means to give a halt-instruction to the audio reproducing means, thereby causing the audio reproducing means to halt its reproducing operation, to be released from the halt state of the reproducing operation and/or to start its reproducing operation again without parting his fingers from the keyboard. It will be apparent from the above description that the musical instrument according to the invention is used conveniently by a beginner player for practicing the musical instrument.

Another embodiment of the invention comprises audio reproducing means, playing operation means, at least one manually operated operator for applying a particular effect to a musical tone to be generated, musical tone generating means for generating a musical tone in response to operation of said performance operation means, function assigning means for assigning a particular function to said manually operated operator, and control means for controlling said audio reproducing means in accordance with the particular function assigned to said manually operated operator when said manually operated operator is operated.

Functions that are assigned to the manually operated operator by the function assigning means are, for example, a function to apply a particular effect to a musical tone to be generated, a function to cause the audio reproducing means to halt its reproducing operation for a short period and a function to cause the audio reproducing means to re-start or to stop its reproducing operation.

In the embodiment of the above construction, operation of the manually operated operator to which a particular function is assigned by the function assigning means is allowed to control the audio reproducing means in accordance with the assigned particular function. Accordingly, when the manually operated operator is operated after the manually operated operator has been assigned a function to halt the reproducing operation of the audio reproducing means, the audio reproducing means is controlled in accordance with teh assinged function so that the audio reproducing means halts its reproducing operation for a short period from the time when the manually operated operator is operated. In a similar manner, operation of the manually operated operator, which has been assigned a function to instruct the audio reproducing means to re-start the reproducing operation, controls the audio reproducing means in accordance with the assigned function so that the audio reproducing means re-starts its reproducing operation from the time when the manually operated operator is operated.

DETAILED DESCRIPTION OF THE PREFERRED EMBODIMENTS

FIRST EMBODIMENT

Figure 1:
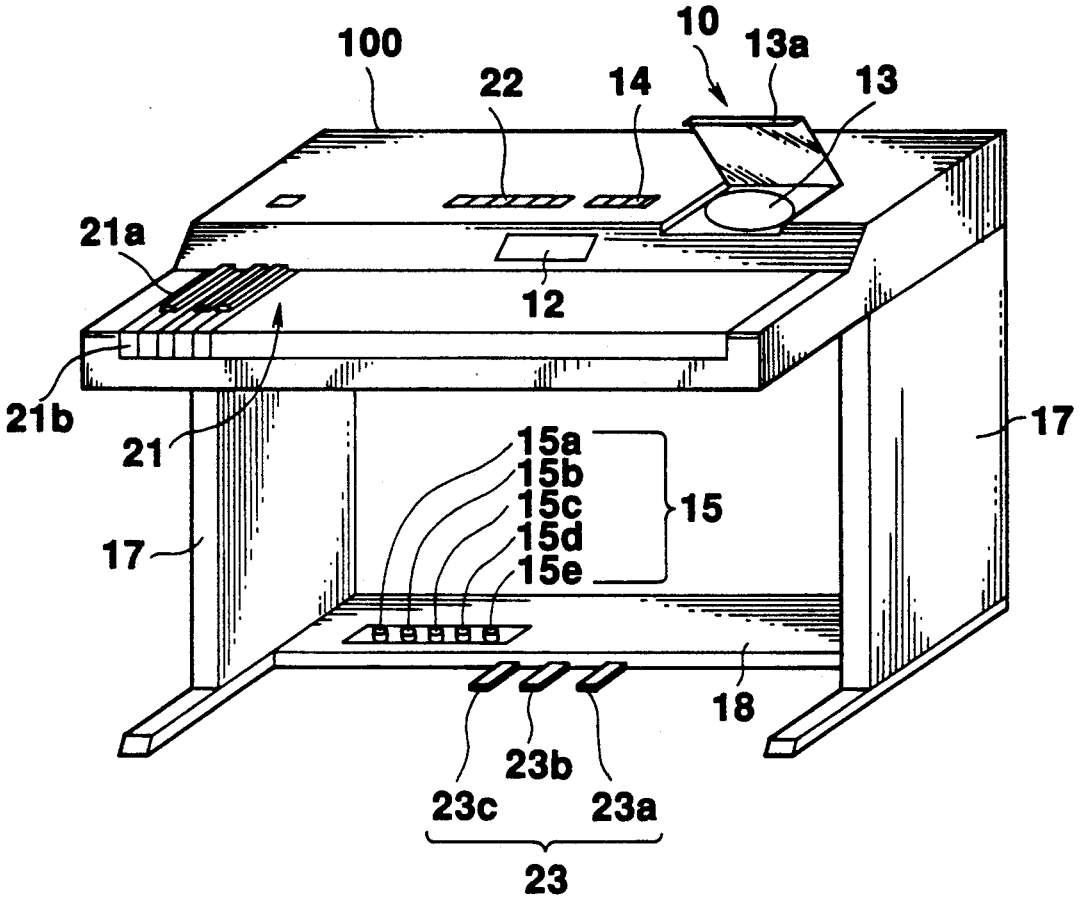
FIG. 1 is an external view of the first embodiment of the invention.
Figure 2:
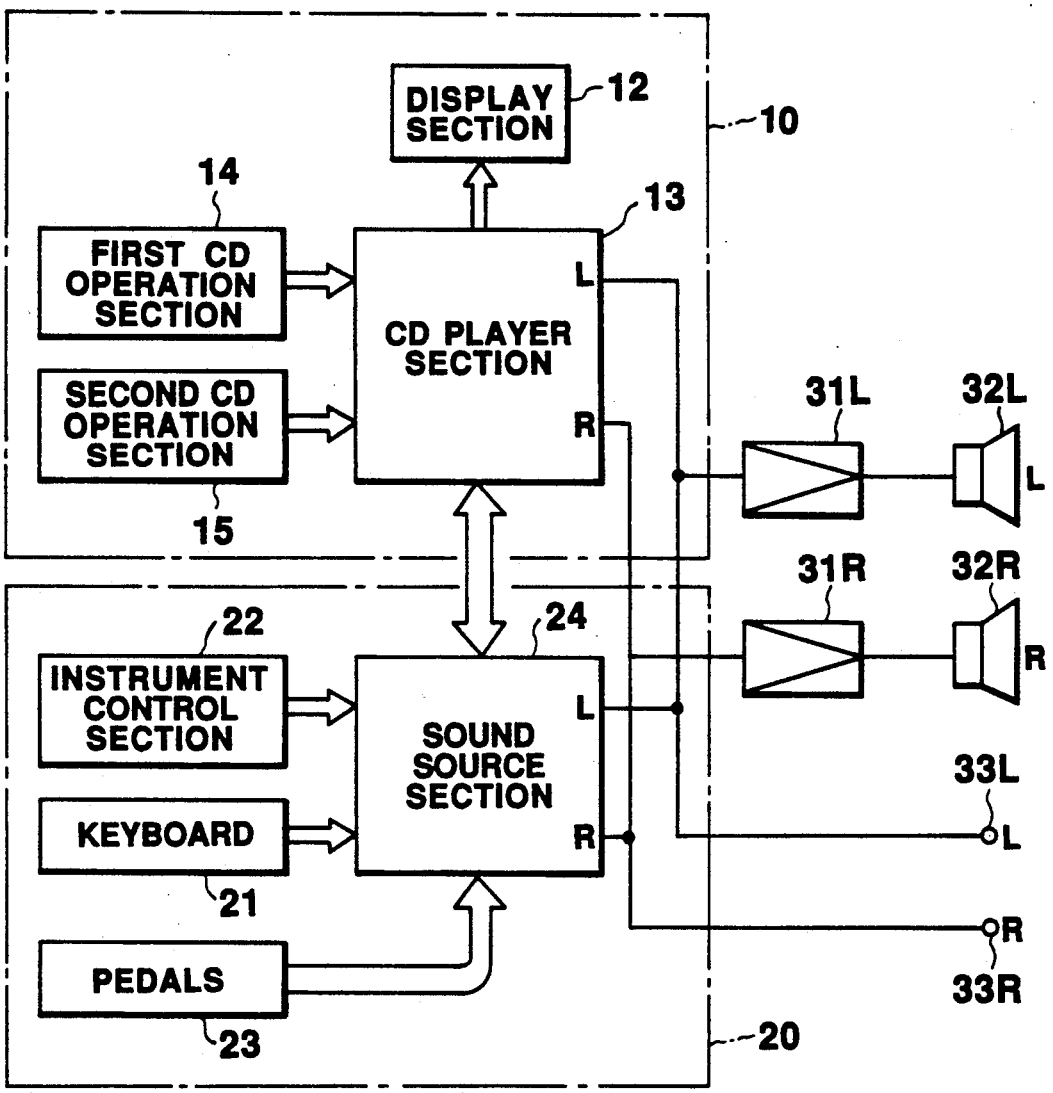
FIG. 2 is a block diagram showing a system of the first embodiment.

FIG. 1 is an external view of a first embodiment of the invention applied to an electronic musical instrument 1 including CD reproducing apparatus.

As shown in FIG. 1, a body 100 of a musical instrument is provided with a keyboard 21 having a plurality of black keys 21*a* and white keys 21*b*, a display section 12 consisting of a liquid crystal display device (LCD) and the like, CD player section 13 for reproducing Compact Disk (CD), a first CD operating section 14 comprising a plurality of switches for setting a particular function (random selection of music pieces, one touch selection of a music piece and repeat reproduction of music pieces) to CD player section 13 and an instrument operation section 22 comprising a plurality of switches for setting various functions (selection of tone volume, tone color) to the electronic musical instrument. The CD player section 13 is mounted in the upper portion of the instrument body 100 and it is provided with a dust cover 13*a* that can be opened and closed. A user is allowed to install a Compact Disk to CD player section 13 with the dust cover 13*a* open.

The instrument body 100 is supported with two support legs 17, 17 at its both end portions.

There is provided a bottom plate 18 attached to and between lower portions of respective support legs 17, 17. The bottom plate 18 is provided with three foot pedals 23 at its central front edge portion. The pedals 23 from the right to the left seen in FIG. 1 are named a DAMPER pedal 23*a*, SOFT pedal 23*b* and SOSTENUTO pedal 23*c*, respectively.

Further on the bottom plate 18 there is provided a second CD operating section 15 at the left to the SOSTENUTO pedal 23*c* which comprises a fast return switch 15*a*, fast forward switch 15*b*, pause switch 15*c*, SYNC switch 15*d* and start/stop switch 15*e*.

Now, functions assigned to the respective switches of the second CD operating section 15 will be described.

(a) The fast return switch 15*a* is used to fast reverse CD.

(b) The fast forward switch 15*b* is used to fast forward CD.

(c) The pause switch 15*c* is used to set a pause-function to halt the reproducing operation for a short period.

(d) The SYNC switch 15*d* is used to bring the reproducing operation in synchronism with a performance by a user after a halt of the reproducing operation.

(e) The START/STOP switch 15*e* is used to cause CD player section 13 to start its reproducing operation or alternatively to stop the same operation.

The DAMPER pedal 23*a*, SOFT pedal 23*b* and SOSTENUTO pedal 23*c* of the electronic keyboard instrument function to apply a DAMPER effect, SOFT effect and SOSTENUTO effect to a musical tone to be generated, respectively and they have the same functions as those of an acoustic piano. Operation signals of the switches of the first CD operating section 14 and operation signals of the switches of the second CD operating section 15 are supplied to CD player section 13.

CD player section 13 comprises (a) a pick up for reading out signals recorded on CD; (b) a tracking servo control circuit for controlling positioning of the pick up; (c) a focus servo control circuit; (d) a spindle motor for controlling revolutions of CD; (e) a spindle servo control circuit for controlling a rotational speed of the spindle motor in Constant Linear Velocity (CLV) method; (f) EFM demodulation circuit for demodulating signals read out by the pick up to convert the same into symbol data in unit of 8 bits (Eight to Fourteen Demodulation); (g) error correction circuit for performing a de-interleave and an error correction on symbol data to produce a demodulated signal; (h) a digital/analog (D/A) converter for converting a demodulated signal into an analog signal; (i) a channel separator circuit for separating an analog signal into a left channel signal and a right channel signal; and (j) CD control section including a micro processor for controlling a timing for operations to be performed by the above circuits. The CD reproducing apparatus 10 comprises the first CD operating section 14, the second CD operating section 15, the display section 12 and the CD player section 13.

The CD reproducing apparatus 10 reproduces CD installed in the CD player section 13 and outputs the reproduced left channel and right channel signal through amplifiers 31L, 31R, and speakers 32L, 32R, respectively and simultaneously supplies the reproduced left channel and right channel signal to a left channel and right channel line-out terminal 33L, 33R, respectively.

Operation signals of the switches of the musical instrument operation section 21, key signals of keys (black keys 21*a*, white keys 21*b*) of the keyboard 21 and operation signals of the pedals 23*a*, 23*b*, 23*c* provided on the bottom plate 18 are supplied to a sound source section 24.

The sound source section 24 comprises a musical tone generating circuit including a pulse code modulation (PCM) tone generator, a phase distortion (PD) tone generator and an FM tone generator each for generating musical tones, an instrument control section including a micro processor, a read only memory (ROM) storing a program under which the instrument control section performs various functions and a random access memory (RAM) including an area for storing various flags and work data. The above instrument control section performs a control operation for applying musical tone characteristics (tone volume, tone color) designated by operation of the instrument operation section 22 to musical tones each having a tone pitch corresponding to an operated key, generated by the musical tone generating circuit and for separating the musical tones into a left channel musical tone signal and a right channel musical tone signal, on the basis of the operation signals of the switches of the instrument operation section 22, key signals of the keys of the keyboard 21 and the operation signals of the pedals 23*a*, 23*b* and 23*c*.

The left and right channel musical tone signal output from the sound source section 24 are sounded through the amplifier 31L, speaker 32L and the amplifier 31R, speaker 32R, respectively, and are simultaneously supplied to the line out terminal 33L of the left channel and the line out terminal 33R of the right channel.

The electronic musical instrument 20 comprises the above keyboard 21, pedals 23 and the sound source 24.

The CD control section of the CD player section 13 and the instrument control section of the sound source 24 are connected so as to be allowed to communicate to each other. As will be described later, for example, the CD control section of the CD player section 13 asks the instrument control section of the sound source 24 in a polling system, if any of the keys 11*a*, 11*b* of the keyboard 21 has been operated, when the reproduction of CD is ready to start the reproducing operation in synchronism with the operation of the above key.

Operation of the First Embodiment

Now, the operation of the main portion of the first embodiment of the invention will be described.

The featuring function of the embodiment is a pause function that brings the CD player section 13 to a halt state of the reproducing operation by foot operation of the foot switch of the PAUSE switch 15*c*, causing it to halt its reproducing operation for a short period. And further, the pause function brings the CD player section 13 by foot operation of the foot switch of SYNC switch 15*d* to a synchronizing state, where the CD player section 13 is ready for starting its reproducing operation in synchronism with operation of a key of the keyboard 21 (a preparation state for CD reproduction in synchronism) and releases the CD player section 13 from the halt state of the reproducing operation, causing it to start its reproducing operation again in synchronism with operation of a key of the keyboard 21 to reproduce CD from a position where it halted its reproducing operation. Hence, in case that a player plays a music piece including a portion of music piece that he can not play well, he is allowed to practice the portion of the music piece as much as he likes by turning on the PAUSE switch 15*c* when he has come to the hard portion of the music piece and then he can start playing the music piece again by turning on the SYNC switch 15*d*. The above switches are operated by foot so that the player is allowed to instantly operate keys, practicing the musical instrument in an easy way.

Figure 3:
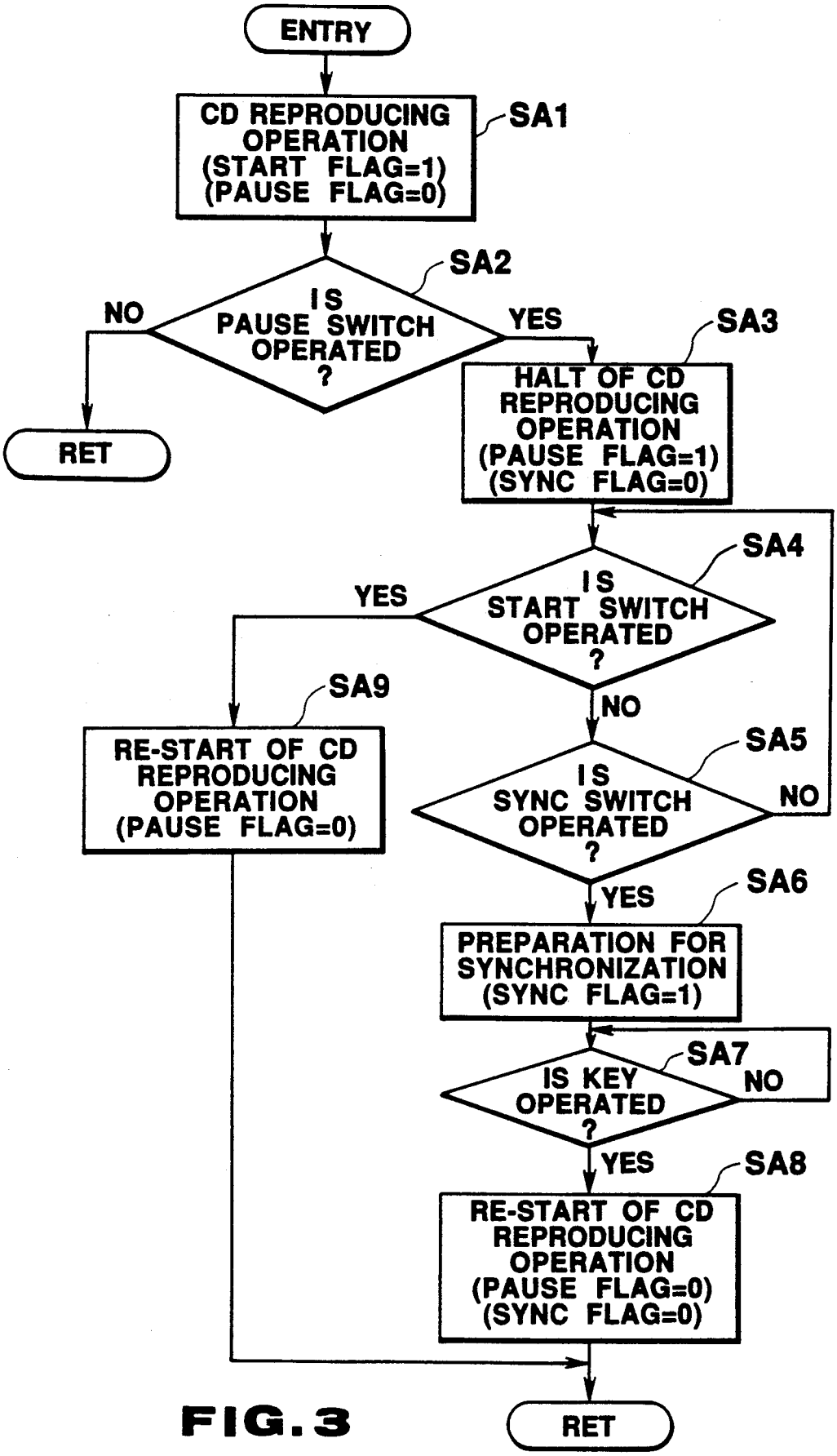
FIG. 3 is a flow chart of the main operation of CD control section of the first embodiment.

Now, a control process of the above function which are performed by CD control section of the CD player section 13 will be described with reference to a flow chart of FIG. 3. The control process of the flow chart of FIG. 3 is performed at the time when a timer interruption is periodically occurred during operation performed by the CD control section under control of the main program.

The CD control section sets the START flag to a value "1" and the PAUSE flag to a value "0" respectively during the reproducting operation of CD at step SA1, and then it judges at step SA2 if the PAUSE switch 20*c* has been operated. When it is judged that the PAUSE switch 20*c* has not been operated, the operation immediately returns to the main routine. When it is judged that the PAUSE switch 20*c* has been operated, the CD control section controls the CD player section 13 so as to halt its reproducing operation for a short period, and at the same time sets the PAUSE flag to a value "1" and the SYNC flag to a value "0", respectively. Meanwhile, the CD control section reads out an absolute lapse time at the time when it is judged that the PAUSE switch 20*c* has been operated, and stores the read out absolute lapse time in a register (not shown) involved in the CD control section at step SA3.

At step SA4, it is judged if START/STOP switch 20*e* has been set to a position START. When it is judged that START/STOP switch 20*e* has been set to a position START, then it is judged at step SA5 if the SYNC switch 20d has been operated.

The CD control section repeats the above processes of judgment at steps SA4, SA5 until START/STOP SWITCH 20e is set to a position START at step SA4 or the SYNC switch 20d is operated.

When it is judged that the SYNC switch 20d has been operated, the CD control section sets the SYNC flag to a value "1" at step SA6 to bring the CD player section ready to start reproducing in synchronism with operation of keys of the keyboard.

Meanwhile, the CD control section performs a polling operation at step SA7, asking the instrument control section in the sound source section 24 if any key of the keyboard 21 has been operated. The CD control section repeats the polling operation at step SA7 until it receives a notice from the sound source section 24 that a key of the keyboard 21 has been operated.

Receiving a notice that a key of the keyboard 21 has been operated, the CD control section reads out the absolute lapse time stored in a pertinent register in the process at step SA3, and controls the CD player section on the basis of the read out absolute lapse time so as to start the reproducing operation again from a position on CD where the CD player section halted the reproducing operation. Further, the CD control section sets both the PAUSE flag and SYNC flag to a value "1" at step SA8. When a key of the keyboard has been operated, a musical tone having a tone pitch corresponding to the operated key is generated with a musical tone characteristic set by operation of the instrument operation section 15.

When the player operates the PAUSE switch 20c by foot while the CD player section 13 is in the reproducing operation as described above, the CD player section 13 halts its reproducing operation for a while (from step SA1 through step SA2 to step SA3). When the SYNC switch 20d is operated by foot while the CD player section 13 is in the halt state, the CD player section 13 is brought to a preparation state for starting CD reproducing operation in synchronism (from step SA3 through steps SA4, SA5 to step SA6). Operation of anyone of keys 21a and 21b of the keyboard 21 causes the CD player section 13 to start the reproducing operation from the position on CD where the player section halted the reproducing operation (from step SA6 through step SA7 to step SA8).

Operating the PAUSE switch 20c and the SYNC switch 20d by foot, the player can stop the CD reproducing operation of the CD player section 13 at a desired position on CD of a music piece for practice for a short period and can start the reproducing operation again from the position on CD where the reproducing operation was stopped. As a result, the player is allowed to practice the musical instrument again in a very simple way.

At step SA4, when it is judged that the START switch 15e has been operated, the CD control section causes, at step SA9, the CD player section to reproduce CD again from the position where the reproducing operation was halted. But at this time the CD control section does not set the SYNC flag to a value "0".

Second Embodiment

Now, the second embodiment of the invention will be described.

External View of the Second Embodiment

Figure 4:
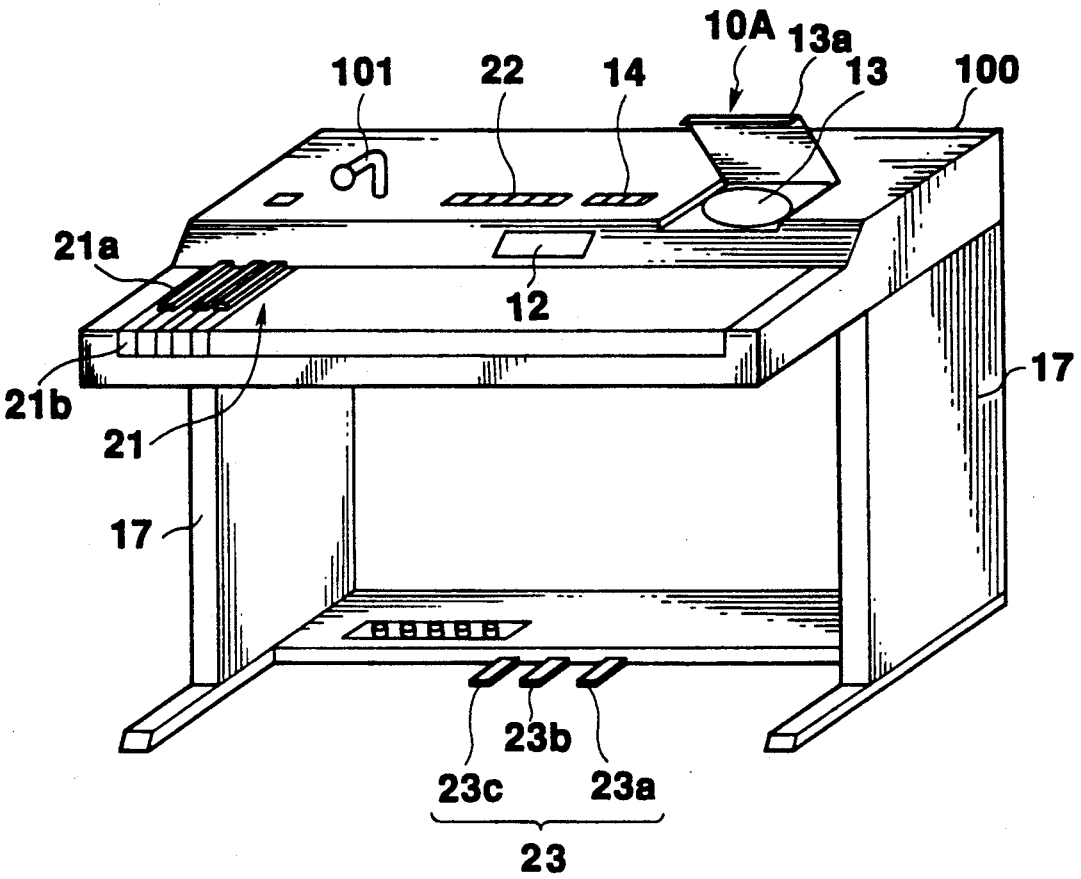
FIG. 4 is an external view of the second embodiment of the invention.

FIG. 4 is an external view of the second embodiment of the invention. In FIG. 4, like parts as those of the first embodiment in FIG. 1 are designated by like reference numerals and their description will be omitted there.

In the second embodiment, a microphone 101 is provided in place of the second CD control section 15 at a location convenient for receiving voices of the player on the upper surface of the body 100 of the musical instrument. The microphone 101 is a single directional microphone that is very sensitive to a sound from its front.

System Construction

Though the first and second embodiment are different in the external appearance but the system construction of the second embodiment is the same as that of the first embodiment except that the CD reproducing apparatus 10A is made partially different from the CD reproducing apparatus 10 of the first embodiment because of the difference in the external appearance.

Figure 5:
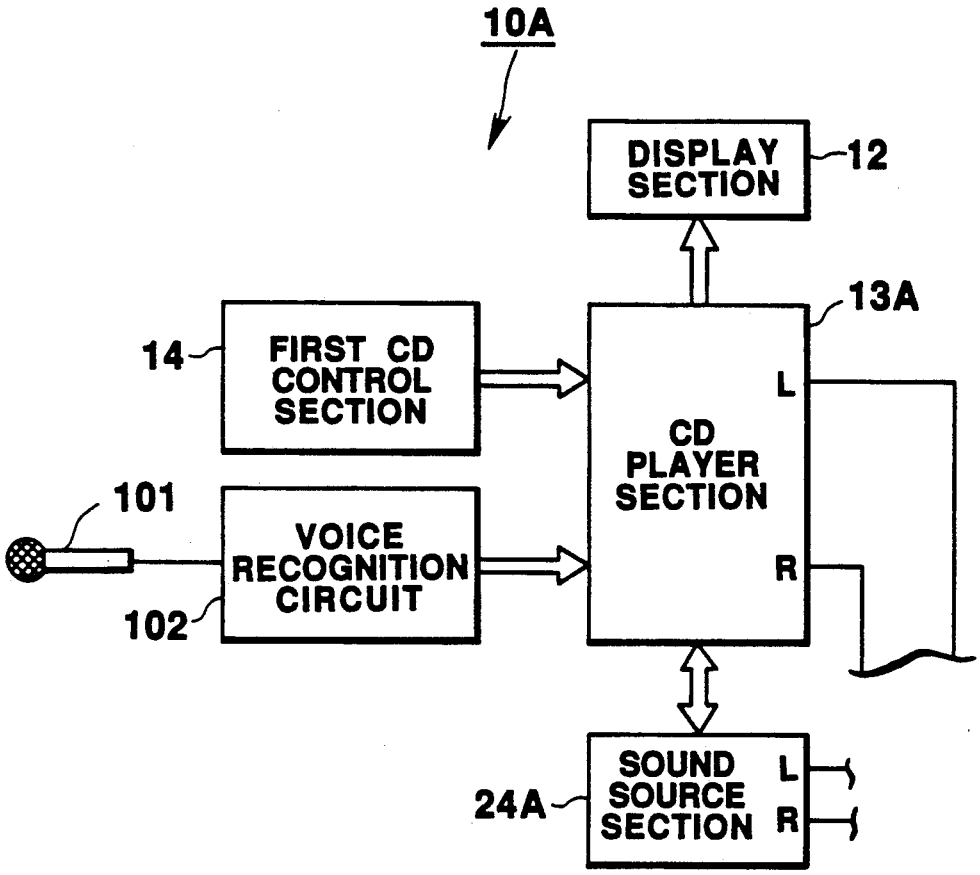
FIG. 5 is a view showing a main part of the system construction of the above second embodiment.

FIG. 5 is a block diagram of the circuit of the CD reproducing apparatus 10A employed in the second embodiment. In FIG. 5, like reference symbols represent like circuit blocks of the CD reproducing apparatus 10 of the first embodiment and a further description thereof will be omitted.

In FIG. 5, a voice signal received by the microphone 101 is supplied to a voice recognition circuit 102. The voice recognition circuit 102 recognizes player's speech with its syllable and word recognition function and converts the recognized speech into a code signal, which is appropriate for processing by the CD control section of the CD player section 13A and then it supplies the code signal to the above CD control section. The CD control section compares the code signal with pattern data of "pause", "synchronization", "start", "stop" and so on stored in a memory such as ROM for voice recognition purpose, thereby recognizing the player's speech, and controls the reproducing operation of CD by the CD player section 13A on the basis of the recognized speech, as will be described in detail.

Operation of the Second Embodiment

Now, operation of the second embodiment having the above construction will be described.

Figure 6:
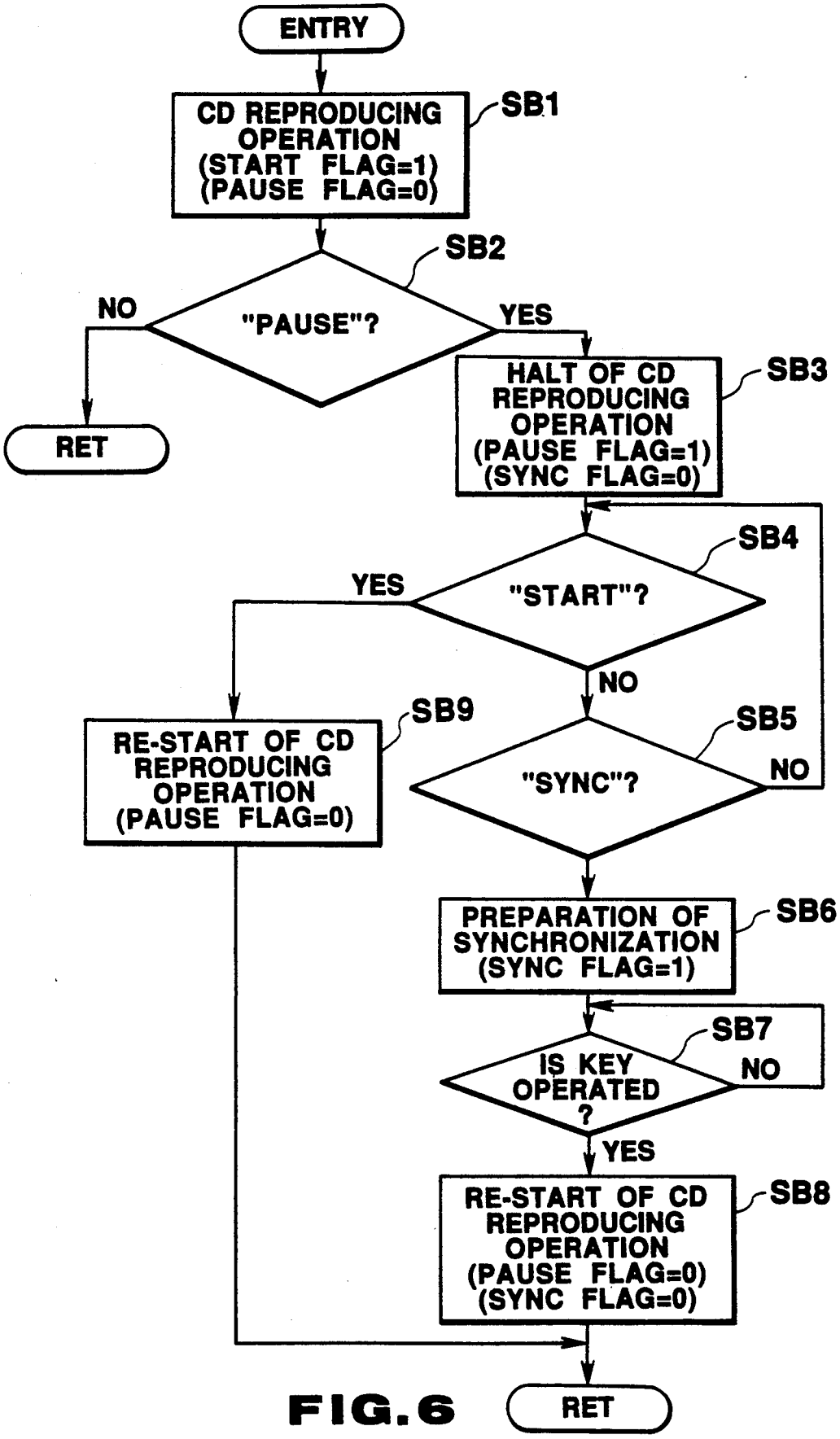
FIG. 6 is a flow chart of the main operation of CD control section in the second embodiment of the invention.

FIG. 6 is a flow chart of operation performed by the CD control section 14 of the CD player section 10A.

The CD control section 14 performs processes almost similar to those performed by the CD control section 14 of the first embodiment. In the first embodiment, the judgments at steps SA2, SA4 and SA5 are made depending on the result of the detection of foot operation of the foot switches (PAUSE switch 15c, SYNC switch 15e and START/STOP switch 15f), while, in the second embodiment, the judgments at steps SB2, SB4 and SB5 are made in accordance with voice data ("PAUSE", "START" and "RESTART") of the player entered through the microphone 101 and the voice recognition circuit 102.

The player is allowed to instruct the CD player section 13A to halt the reproducing operation, bringing it to the preparation state for starting the reproducing operation in synchronism by inputting his voices "PAUSE" (corresponding to operation of the PAUSE switch 15c in the first embodiment) and "SYNCHRO- NIZATION" (corresponding to operation of the SYNC switch 15*d*) to the microphone 101. In the second embodiment, since there is no need for the player to move his foot apart from the pedals 23*a*, 23*b* and 23*c*, he can control the CD player section 13A more easily than in the first embodiment.

Third Embodiment

The third embodiment of the invention will be described. The external view of the third embodiment is almost similar to that of the second embodiment shown in FIG. 4. Features of the present embodiment resides in that an instrument operation section (i.e., mode selection means) 22A is provided with a sliding type switch of three stages for selectively setting the SOSTENUTO pedal 23*a*, SOFT pedal 23*b* and DAMPER pedal 23*c* to a function setting switch for pedals of the CD reproducing apparatus 10.

Figure 7:
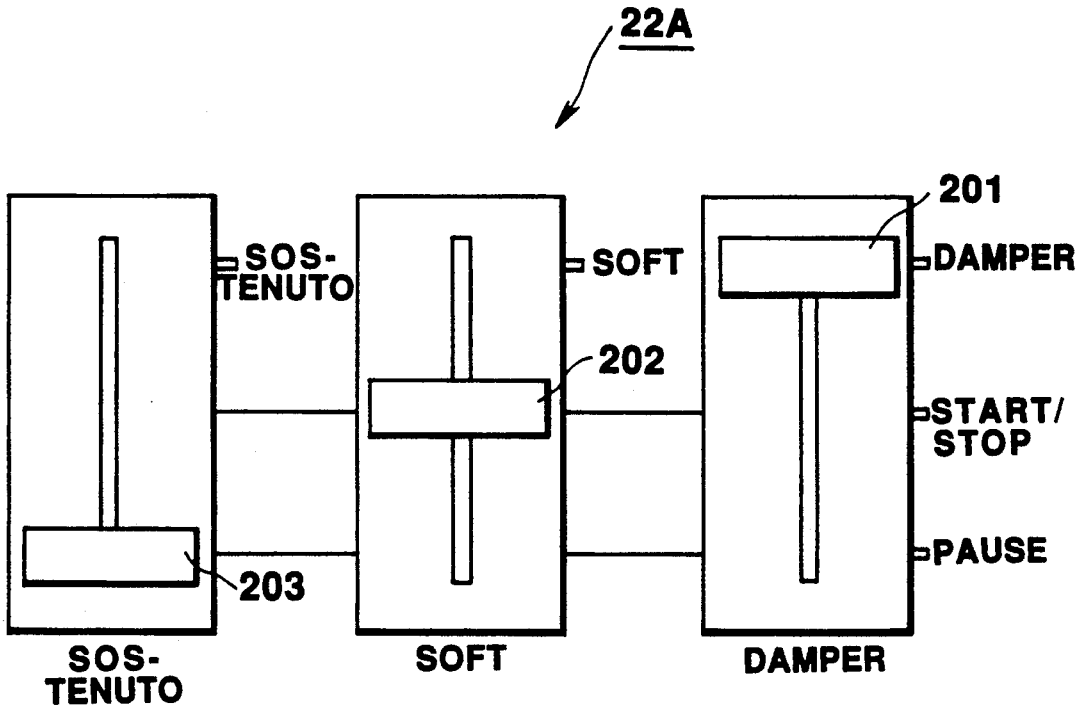
FIG. 7 is an external view of function setting switches provided in an instrument control section of the third embodiment of the invention.

FIG. 7 is an external view of setting switches mounted on the instrument operation section (mode selection means) 22A.

As shown in FIG. 7, the instrument operation section or mode selection means 22A is provided with function setting switches such as a DAMPER function setting switch 201, a SOFT function setting switch 202 and a SOSTENUTO function setting switch 203, which are disposed close to each other in parallel in the above mentioned order from the right to the left seen in FIG. 7. Names of these function setting switches 23*a*, 23*b* and 23*c*, "DAMPER", "SOFT" and "SOSTENUTO" are printed underneath respective switches. A top position in the sliding path of each function setting switch 201, 202 and 203 is for assigning the inherent function to respective pedals 23*a*, 23*b* and 23*c*. Each center position in the sliding paths is for assigning each pedal 23 the same function as the START/STOP switch 15*e* of the first embodiment. Similarly, a bottom position in the sliding paths is for assigning the same function as that of the PAUSE switch 15*e* of the first embodiment to the respective pedals 23*a*, 23*b* and 23*c*.

Operation of the function setting switches 201, 202 and 203 selectively sets the inherent function of the pedals, a pause function of CD reproducing operation or START/STOP function to the DAMPER pedal 23*a*, SOFT pedal 23*b* and SOSTENUTO pedal 23*c*. Therefor, upon operation of the above function setting switches 201, 202 and 203 before or during a performance, the player is allowed to operate the CD player section by operation of the pedals 23*a*, 23*b* and 23*c* to make it start CD reproducing operation, halt CD reproducing operation for a short period and start CD reproducing operation again after a pause for the short period.

System Construction

The system construction of the third embodiment is almost similar to that of the second embodiment. The CD control section of the CD player section 13A and the sound source section 24A are adapted to be able to communicate each other while an interrupt is caused.

The sound source section 24A is provided with an instrument control section and RAM connected through an address bus and data bus to the instrument control section. The RAM includes an area for storing the latest positions where the function setting switches (the DAMPER function setting switch 201, SOFT function setting switch 202 and SOSTENUTO function setting switch 203) have been set.

Figure 8:
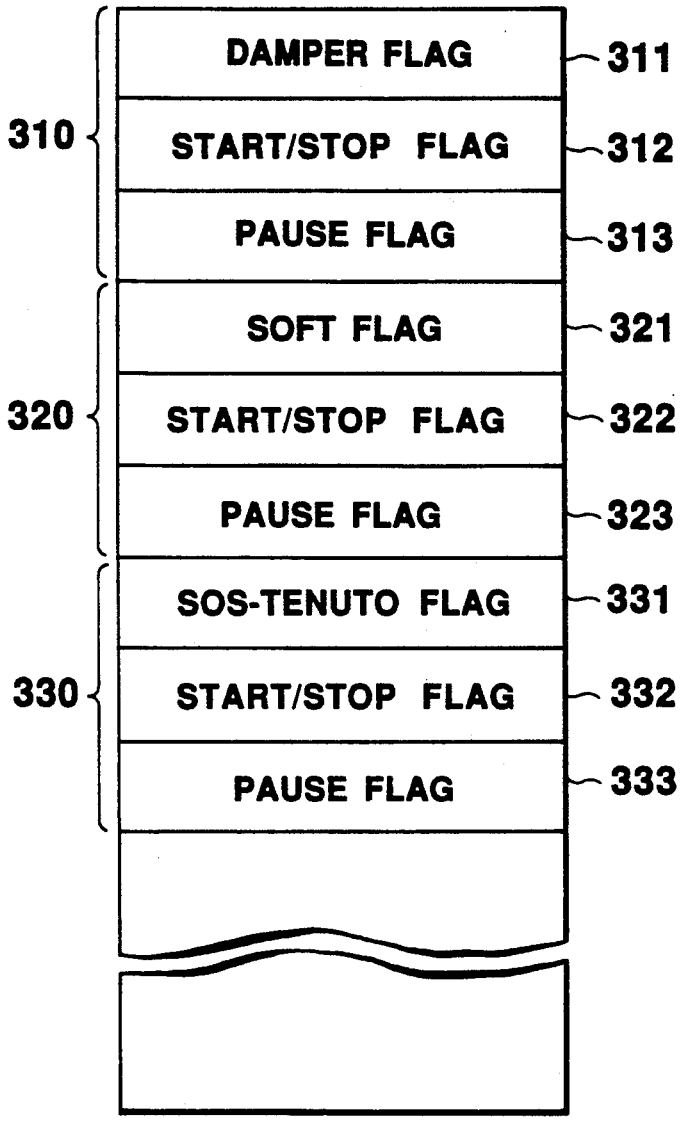
FIG. 8 is a view showing a construction of a flag area provided in RAM.

FIG. 8 is a view showing an internal construction of the RAM.

As shown in FIG. 8, RAM is provided with a flag area 310 for the DAMPER pedal, a flag area 320 for the SOFT pedal and a flag area 330 for the SOSTENUTO pedal. The above respective flag areas 310, 320, 330 have START/STOP flags 312, 322, 332 and PAUSE flags 313, 323, 333 respectively. Further, the flag area 310 has a DAMPER flag 311, the flag area 320 has a SOFT flag 321 and the flag area 330 has a SOSTENUTO flag 331.

Since the above flag areas 310, 320 and 330 are of a similar construction, only the DAMPER flag area 310 will be described and the description of the other flag areas will be omitted.

(a) DAMPER flag 311 is set to a value "1", when the DAMPER pedal 23*c* has its inherent function. When it is set to a value "0", the DAMPER pedal 23*a* has a function for controlling CD reproducing operation.

(b) START/STOP flag 312 is set to a value "1", when the DAMPER pedal 23*a* is used to control the CD player section so as to make it start or stop CD reproducing operation.

(c) PAUSE flag 313 is set to a value "1", when the DAMPER pedal 23*a* is used to control the CD player section so as to make it halt CD reproducing operation for a short period.

Only one of the above flags 331, 332 and 333 is set to a value "1" at all times and the other flags are set to "0".

Hence, when the DAMPER pedal 23*a* has its inherent function, only the DAMPER flag 311 is set to a value "1". Similarly, when the DAMPER pedal 23*a* is used to start or stop CD reproducing operation, only START/STOP flag 312 is set to a value "1".

When the DAMPER pedal 23*a* is used to halt CD reproducing operation for a short period, only PAUSE flag 313 is set to a value "1".

Each flag within the flag areas in the flag area 320 for the SOFT pedal and the flag area 330 for the SOSTENUTO pedal has a similar function to that of each flag within the flag area 310 for the DAMPER pedal, except that the SOSTENUTO flag corresponds to the SOSTENUTO pedal 23*c* and the SOFT flag corresponds to the SOFT pedal 23*b*. Therefor, a further description of the flags will be omitted.

Operation of the Third Embodiment

Now, operation of the third embodiment having the above construction will be described.

When a player plays a conventional keyboard musical instrument, he sets the DAMPER function setting switch 201, SOFT function setting switch 202 and the SOSTENUTO function setting switch 203 to their top positions in the sliding paths to give their inherent functions to pedal 23*a*, 23*b* and 23*c*, respectively. Then, the player is allowed to play the piano, applying the DAMPER effect, SOFT effect and/or SOSTENUTO effect to piano sounds by operating the DAMPER pedal 23*a*, SOFT pedal 23*b* and/or the SOSTENUTO pedal 23*c*.

Meanwhile, in case that the player plays the piano by operating the keyboard 21 with a music piece for piano practice being reproduced, two of the DAMPER function setting switch 201, SOFT function setting switch 202 and the SOSTENUTO function setting switch 203 are used for controlling CD reproducing operation of the CD player section. For example, as shown in FIG. 7, the DAMPER function is set to the DAMPER pedal 23a by the DAMPER function setting switch 201, START/STOP function is set to the SOFT pedal 23b by the SOFT function setting switch 202 and the PAUSE function is set to the SOFT pedal 23c by the SOSTENUTO pedal 23c by the SOSTENUTO function setting switch 203. Then, the player is allowed to apply DAMPER effect onto musical tones being generated in accordance with operation of the keyboard 21 by stepping on the DAMPER pedal 23a. The player can controls the CD player section so as to stop or start its CD reproducing operation by stepping the SOFT pedal 23b, too. Further, the player can halt the CD reproducing operation for a while by stepping the SOSTENUTO pedal 23c. Similarly, operation in various ways of the DAMPER function setting switch 201, SOFT function setting switch 202 and the SOSTENUTO function setting switch 203 gives respective pedals 23a, 23b and 23c their inherent functions or gives them control function (START/STOP function or pause function) for the CD player section.

Figure 9:
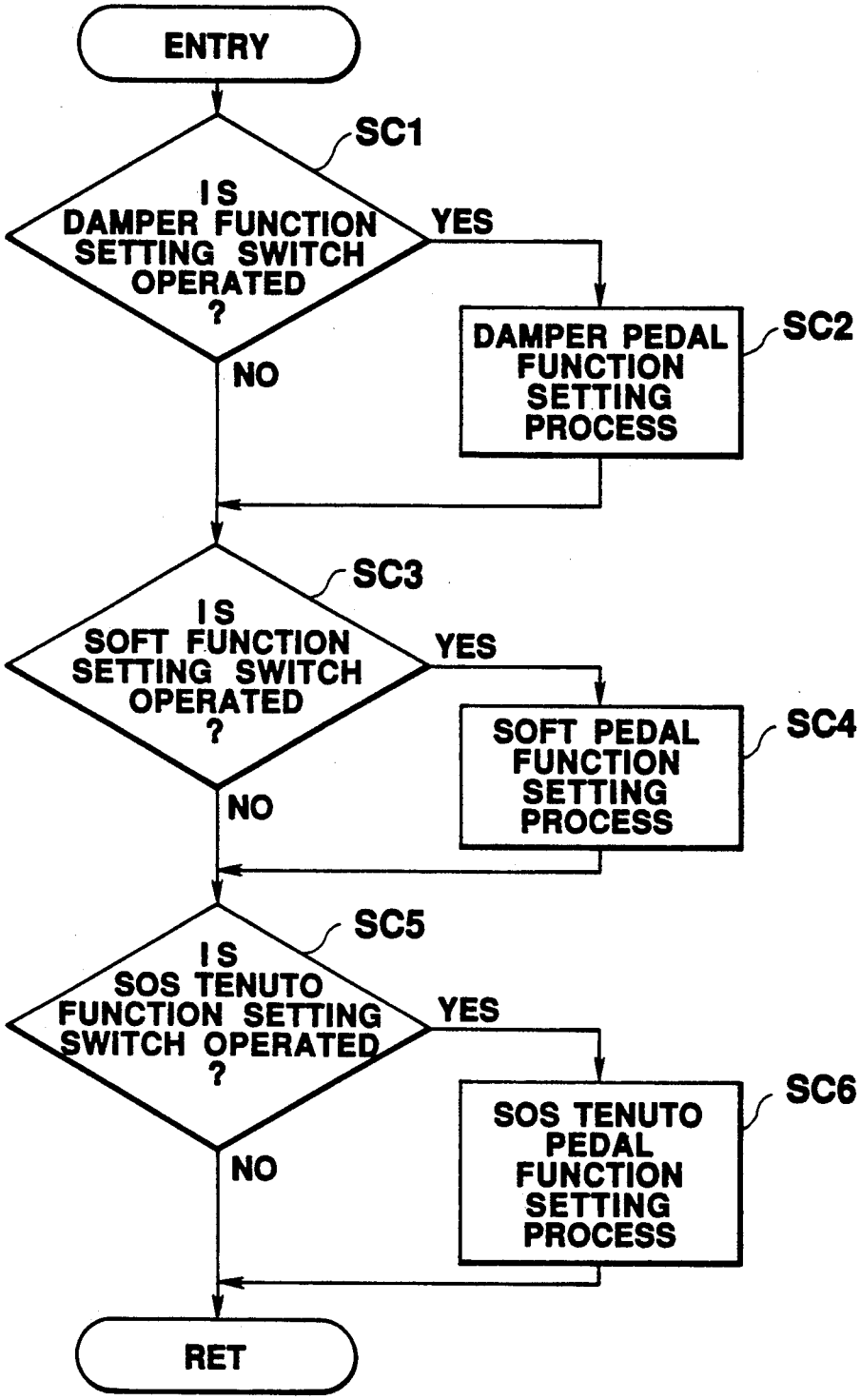
FIG. 9 is a flow chart of a scanning process of the function setting switches performed by the musical instrument control section of the third embodiment.

Now, a scanning operation of the pedal function setting switches performed by the instrument control section of the sound source section 24A will be described with reference to a flow chart of FIG. 9.

The scanning operation is involved in the main routine operation performed by the instrument control section and is repeatedly performed while the power source of the musical instrument is turned on.

In the scanning operation, the instrument control section judges if the DAMPER function setting switch 201, SOFT function setting switch 202 and the SOSTENUTO function setting switch 203 have been operated to change their sliding positions at steps SC1, SC3, SC5. When the instrument control section judges that each of the DAMPER function setting switch 201, SOFT function setting switch 202 and the SOSTENUTO function setting switch 203 has been operated to change its sliding position, then a DAMPER pedal function setting process SC2 (for DAMPER function setting switch 201), SOFT pedal function setting process SC3 (for SOFT function setting switch 202) and SOSTENUTO function setting process SC4 (for SOSTENUTO function setting switch 203) are performed to set a value of the flags in RAM of FIG. 8 based on the changed sliding positions of the above function setting switches.

Figure 10:
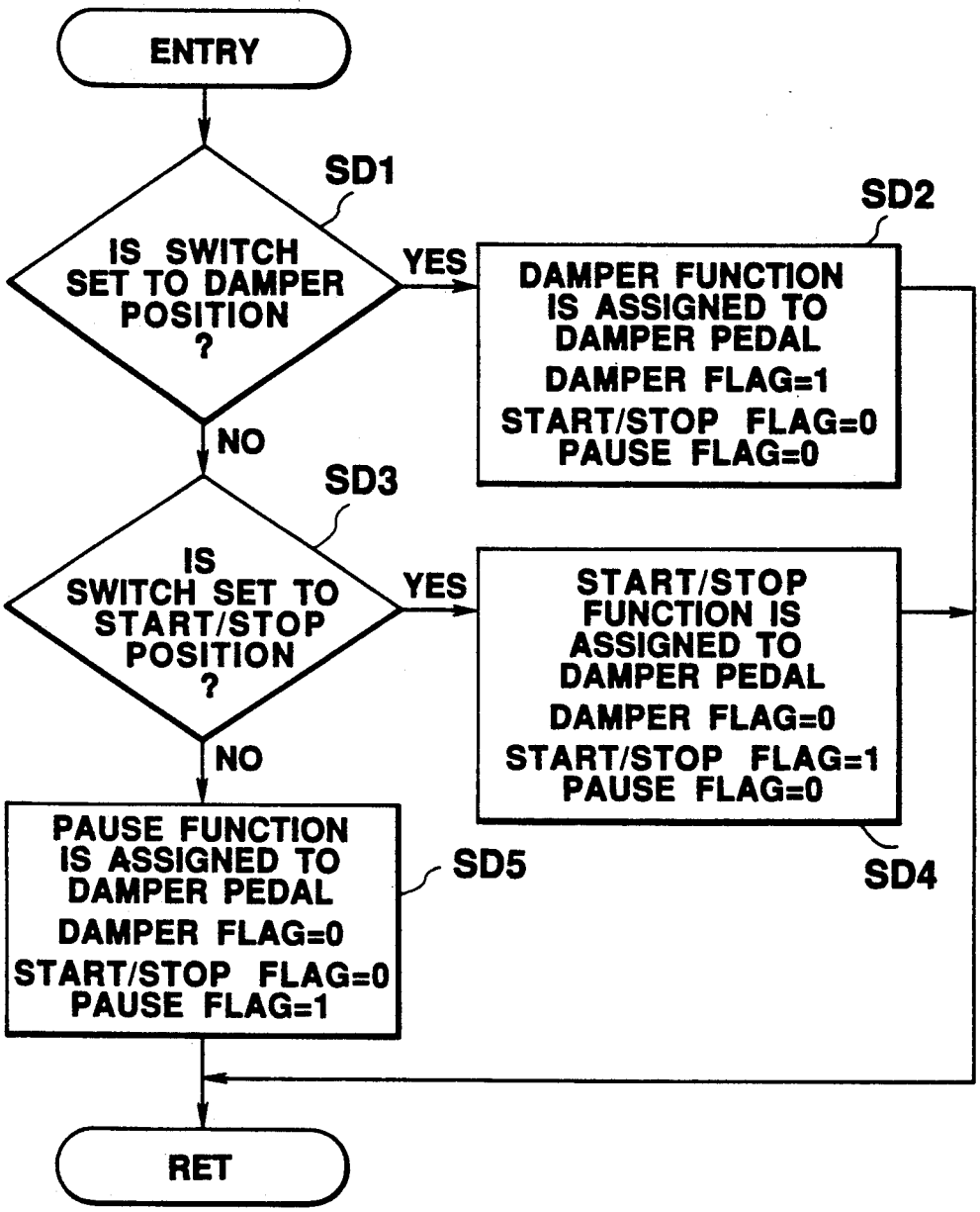
FIG. 10 is a flow chart of a DAMPER function setting process performed by the instrument control section of the third embodiment.

Now, the DAMPER function setting process SC2 will be described in detail with reference to a flow chart of FIG. 10.

The instrument control section judges at step SD1 if the DAMPER function setting switch 201 has been set to a position for setting the DAMPER function. When it is judged that the DAMPER function setting switch 201 has been set to a position for setting the DAMPER function, the instrument control section sets the DAMPER flag 311 to a value "1" and the START/STOP flag 312 and PAUSE flag 313 to a value "0", respectively at step SD2.

Meanwhile, when it is judged at step SD1 that the DAMPER function setting switch 201 has not been set to a position for setting the DAMPER function, the instrument control section judges at step SD3 if the DAMPER function setting switch 201 has been set to the START/STOP position for setting START/STOP function. When it is judged that the DAMPER function setting switch 201 has been set to the START/STOP position, the instrument control section sets START/STOP flag 312 to a value "1" and the DAMPER flag 311 and the PAUSE flag 313 to a value "0", respectively at step SD4.

When it is judged at step SD3 that the DAMPER function setting switch 201 has not been set to the START/STOP position, the instrument control section judges at step SD5 that the DAMPER function setting switch 201 has been set to the position for setting the pause function and it sets the PAUSE flag 313 to a value "1" and the DAMPER flag 311 and the START/STOP flag 312 to a value "0".

As described above, when the DAMPER function setting switch 201 is set to the position for setting the DAMPER function, only DAMPER flag 311 shall be set to a value "1". When the DAMPER function setting switch 201 is set to the position for setting START/STOP function or to the position for setting PAUSE function, only the START/STOP flag shall be set to a value "1" or only the PAUSE flag 313 shall be set to a value "1".

When the instrument control section of the sound source section 24A detects operation of the DAMPER pedal 23a, it judges which of the DAMPER flag 311, START/STOP flag 312 and PAUSE flag 313 raises a flag. When it is judged that the DAMPER flag 311 has raised a flag, the instrument control section controls so as to apply the the DAMPER effect to musical tones being generated. Meanwhile, when it is judged that the START/STOP flag 312 has raised a flag, the instrument control section instructs the CD control section of the CD player section 13A so as to start or stop CD reproducing operation. Then, receiving the instruction to start CD reproducing operation, the CD control section controls the CD player section to cause it to start CD reproducing operation when it is not in the reproducing operation or to cause it to start CD reproducing operation again, when it is in the halt state (CD reproducing operation is halted for a while). Further, when the CD control section receives the instruction to stop the CD reproducing operation, it causes the CD player section to stop CD reproducing operation instantly.

When it is judged that the PAUSE flag 313 has raised a flag, the instrument control section instructs the CD control section of the CD player section 13A so as to cause it to halt the CD reproducing operation for a short period. Receiving the instruction to halt the CD reproducing operation, the CD control section causes the CD player section to halt the CD reproducing operation.

The SOFT pedal function setting process at step SC4 and the SOSTENUTO pedal function setting process at step SC6 are performed in almost the same way as the above DAMPER pedal function setting process at step SC2 except that a flag to be set is different.

In the SOFT pedal function setting process at step SC4, the SOFT flag 312, START/STOP flag 322 and PAUSE flag 323 are set and in the SOSTENUTO pedal function setting process at step SC6, the SOSTENUTO flag 331, START/STOP flag 332 and PAUSE flag 323 are set. Detecting operation of the SOFT pedal 23b or operation of the SOSTENUTO pedal 23c, the instrument control section of the sound source section 24A instructs the CD control section of the CD player section 13A at a pertinent timing, in the similar way to that of the DAMPER pedal 23a, so as to start or halt CD reproducing operation depending on the values of the flags. When the SOFT flag and the SOSTENUTO flag have raised flags, the SOFT effect and SOSTENUTO effect are applied to musical tones being generated.

What is claimed is:

1. An electronic musical instrument comprising:

audio reproducing means mounted on an instrument body;

foot operating means mounted on a lower portion of said instrument body for giving said audio reproducing means an instruction to halt a reproducing operation of an audio signal;

a plurality of keys which are selectively operable for instructing generation of relevant pitch data when at least one of said plurality of keys is operated;

musical tone generating means for generating a pertinent musical tone having a pitch corresponding to said pitch data in response to operation of at least one of said plurality of keys; and audio-reproduction re-start instruction means for giving said audio reproducing means an instruction to start a reproducing operation again, from a position where said audio reproducing means halted a reproducing operation of said audio signal, in response to operation of at least one of said plurality of keys, when said at least one of said plurality of keys is operated while said audio reproducing means halts a reproducing operation of said audio signal.

2. An electronic musical instrument according to claim 1, wherein said audio reproducing means comprises a compact disc player for reproducing an audio signal recorded on a compact disc.

* * * * *